US005440986A

United States Patent [19]

Braun

[11] Patent Number: 5,440,986

[45] Date of Patent: Aug. 15, 1995

[54] WASHING DEVICE FOR CYLINDERS OF A PRINTING PRESS

[75] Inventor: Michael Braun, Speyer, Germany

[73] Assignee: Heidelberger Druckmaschinen AG, Heidelberg, Germany

[21] Appl. No.: 206,436

[22] Filed: Mar. 4, 1994

[30] Foreign Application Priority Data

Mar. 4, 1993 [DE] Germany ..... 43 06 676.3

[51] Int. Cl.[6] ..... B41F 35/00

[52] U.S. Cl. ..... 101/423; 101/425

[58] Field of Search ..... 101/423, 425, 424

[56] References Cited

U.S. PATENT DOCUMENTS

| | | | |
|---|---|---|---|
| 4,981,078 | 1/1991 | Dettinger et al. | 101/424 |
| 4,986,182 | 1/1991 | Sawaguchi et al. | 101/483 |
| 5,105,740 | 4/1992 | Loos et al. | 101/423 |
| 5,125,342 | 6/1992 | Hara | 400/425 |
| 5,150,653 | 9/1992 | Hara | 101/483 |
| 5,255,606 | 10/1993 | Iijima et al. | 101/425 |

FOREIGN PATENT DOCUMENTS

| | | |
|---|---|---|
| 0315144 | 5/1989 | European Pat. Off. . |
| 3841260 | 3/1990 | Germany . |
| 4142422 | 6/1991 | Germany . |
| 2222552 | 3/1990 | United Kingdom . |

*Primary Examiner*—Edgar S. Burr

*Assistant Examiner*—Anthony H. Nguyen

*Attorney, Agent, or Firm*—Herbert L. Lerner; Laurence A. Greenberg

[57] ABSTRACT

Washing device for cylinders of a printing press including an exchangeable supply reel mounted on a clean-cloth spindle and having a cleaning cloth running off therefrom, a pressure pad for pressing the cleaning cloth against a circumferential surface of a respective cylinder of the printing press, a dirty-cloth spindle onto which the cleaning cloth is windable, and a drive mechanism for sectionally feeding the cleaning cloth and for rewinding the cleaning cloth from the dirty-cloth spindle onto the supply reel on the clean-cloth spindle, is provided with a device for automatically pulling the cleaning cloth into the washing device, respective deflector members disposed on the clean-cloth spindle and in vicinity of the pressure pad, the pulling device including at least one traction device endlessly revolvable over the deflector members, a gripper device carried by the traction device for gripping a leading edge of the cleaning cloth running off the supply reel, and a device disposed in vicinity of the dirty-cloth spindle for opening the gripper device to receive the leading edge of the cleaning cloth therein, the dirty-cloth spindle carrying adhesion elements on a circumferential surface thereof engageable with the cleaning cloth.

10 Claims, 3 Drawing Sheets

4
2
1
3

WASHING DEVICE FOR CYLINDERS OF A PRINTING PRESS

SPECIFICATION

The invention relates to a-washing device for cylinders of a printing press and, more particularly, to such a washing device including an exchangeable supply reel mounted on a clean-cloth spindle and having a cleaning cloth running off therefrom, a pressure pad for pressing the clean cloth against a circumferential surface of a respective cylinder of the printing press, a dirty-cloth spindle onto which the clean cloth is windable, and drive means for sectionally feeding the clean cloth and for rewinding the cleaning cloth from the dirty-cloth spindle onto the supply reel on the clean-cloth spindle.

A washing device for printing presses having such generic features has become known heretofore known from published German Patent Document DE 38 41 260 A1. The cleaning cloth, running-off from a supply reel on a clean-cloth spindle, is guided around the outside of the pressure pad, which is arranged so as to be linearly movable and is formed of an elastic material. The used cleaning cloth is then wound onto the dirty-cloth spindle. Both spindles of the conventional washing device are connected to an electromotive drive having an electronic control program which, for each cleaning operation, limits the feed of the cleaning cloth to a predetermined section and, after completion of the cleaning operation, partly rewinds the cleaning cloth, so that the region of the cleaning cloth which was less dirtied in the final phase of the cleaning operation is re-used for precleaning in the next cleaning operation. After the supply of cleaning cloth on the supply reel has been used, it is rewound from the dirty-cloth spindle onto the supply reel of the clean-cloth spindle, so that the pressman has to replace only one reel of cloth. Drives which are suitable for such a dirty-cloth drive are described in detail in published European Patent Document 0 315 144 A2 and in U.S. Pat. No. 5,125,342, which are approximately identical in content.

When the cleaning cloth is being replaced, the front or leading end of the web of cloth must be pulled manually through the washing device and guided over the deflectors or pulleys around the outside of the pressure pad to the dirty-cloth spindle and fixed thereto.

It is consequently an object of the invention to provide a washing device for cylinders of a printing press wherein changing of the cleaning cloth is facilitated and the time required heretofore for such changing is shortened.

With the foregoing and other objects in view, there is provided, in accordance with the invention, a washing device for cylinders of a printing press including an exchangeable supply reel mounted on a clean-cloth spindle and having a cleaning cloth running off therefrom, a pressure pad for pressing the cleaning cloth against a circumferential surface of a respective cylinder of the printing press, a dirty-cloth spindle onto which the cleaning cloth is windable, and drive means for sectionally feeding the cleaning cloth and for rewinding the cleaning cloth from the dirty-cloth spindle onto the supply reel on the clean-cloth spindle, comprising means for automatically pulling the cleaning cloth into the washing device, respective deflector members disposed on the clean-cloth spindle and in vicinity of the pressure pad, the pulling means including at least one traction means endlessly revolvable over the deflector members, gripper means carried by the traction means for gripping a leading edge of the cleaning cloth running off the supply reel, and means disposed in vicinity of the dirty-cloth spindle for opening the gripper means to receive the leading edge of the cleaning cloth therein, the dirty-cloth spindle carrying adhesion elements on a circumferential surface thereof engageable with the cleaning cloth.

An outstanding advantage of such a device is that the front or leading end of the unused cleaning cloth is gripped by the gripper means on the endlessly revolvably guided traction means and is pulled or drawn into the washing device by the traction means while the reel of cloth is being changed. The traction means may be moved either manually or by a motorized drive. In its simplest form, the gripper means for the front or leading end of the cleaning cloth is closed manually. A toothed belt, in particular, is provided for the traction means. Also suitable, however, is a belt strap which is relatively inelastic in the longitudinal direction, a link chain or a steel cable, for example.

In a preferred embodiment, such traction means with gripper means attached thereto is provided on each printing-press side. In addition, a fixed edge, projecting widthwise beyond the cleaning cloth, is formed on the front or leading edge of the cleaning cloth running off the supply reel on the clean-cloth spindle or is retrospectively connectable to the front or leading edge of the clean cloth, so that the side ends of the fixed edge can be inserted by hand into the opened gripper means on the two traction means, and the gripper means can be closed by hand, possibly through the intermediary of auxiliary means.

Due to the motion of the traction means, the cleaning cloth is pulled as far as the dirty-cloth spindle and is connected thereto in a manner fixed against rotation. For this purpose, in accordance with a further embodiment of the invention, a cloth-guiding plate is disposed in the region of the dirty-cloth spindle, the cloth-guiding plate pressing the incoming dirty cloth against adhesion elements disposed on the circumference or outer cylindrical surface of the dirty-cloth spindle, in order to secure the dirty cloth to the circumference or outer cylindrical surface of the dirty-cloth spindle. A gripper-opening cam is provided in the region of the dirty-cloth spindle for opening the gripper means, the gripper-opening cam cooperating with a gripper lug on the gripper means. The arrangement of a gripper-closing cam in the region of the clean-cloth spindle ensures that a cleaning cloth will be drawn automatically into the washing device.

Thus, in accordance with another feature of the invention, the drive means comprise a motorized drive for the endlessly revolvable traction means.

In accordance with a further feature of the invention, the endlessly revolvable traction means comprise at least one of a belt strap, a toothed belt, a chain and a cable.

In accordance with an added feature of the invention, at least one of the traction means, respectively, carrying the gripper means is disposed on each side of the printing press.

In accordance with an additional feature of the invention, the means for opening the gripper means comprise a cam lug formed on a movable finger of the gripper means, and a gripper-opening cam fixed to the printing-press frame in vicinity of the dirty-cloth spindle.

In accordance with yet another feature of the invention, the washing device includes a cloth-guiding plate disposed in vicinity of the dirty-cloth spindle for pressing the cleaning cloth against the circumferential surface of the dirty-cloth spindle.

In accordance with yet a further feature of the invention, the cloth-guiding plate is movably guidable, and a spring for radially spring-loading the cloth-guiding plate against the circumferential surface of the dirty-cloth spindle is included.

In accordance with yet an added feature of the invention, the washing device includes a gripper-closing cam disposed in a locally-fixed manner in vicinity of the clean-cloth spindle for closing the gripper means.

In accordance with yet an additional feature of the invention, the washing device includes a fixed edge integral with the leading edge of the cleaning cloth running off the supply reel on the clean-cloth spindle, the fixed edge projecting widthwise beyond the cleaning cloth.

In accordance with a concomitant feature of the invention, the fixed edge is a strip of material affixed to the leading edge of the cleaning cloth.

Other features which are considered as characteristic for the invention are set forth in the appended claims.

Although the invention is illustrated and described herein as embodied in a washing device for cylinders of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
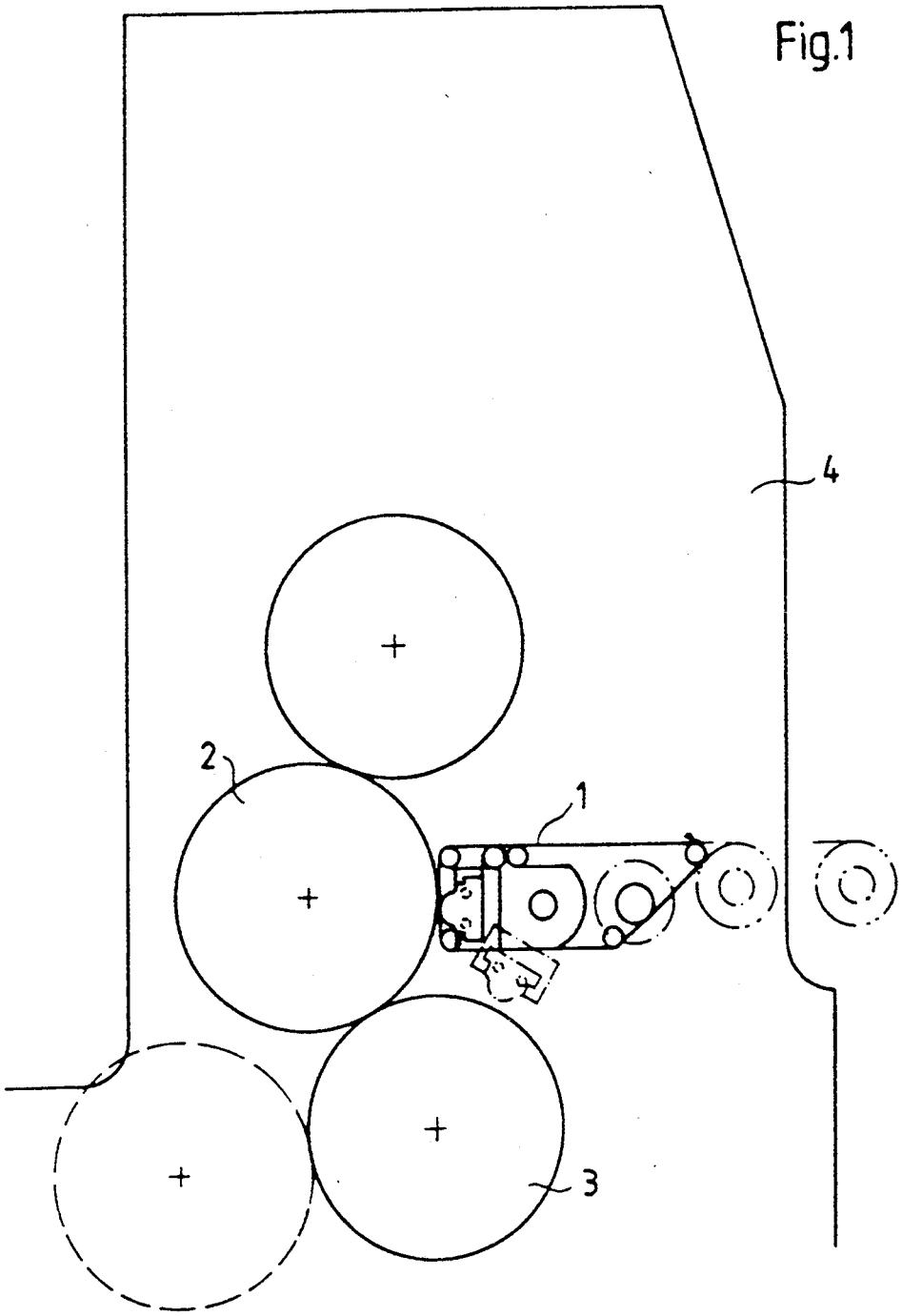
FIG. 1 is a diagrammatic side elevation view of a printing unit of an offset printing press provided with a washing device according to the invention.
Figure 2:
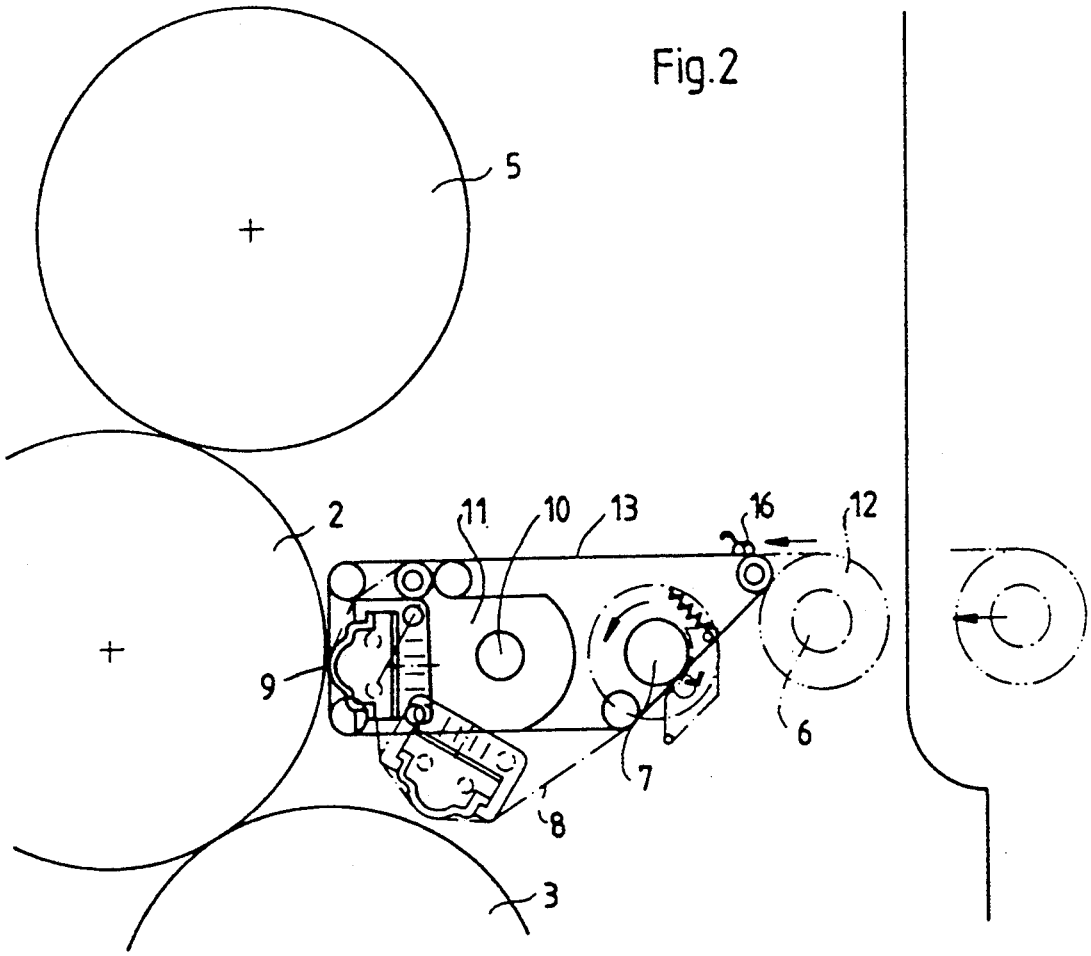
FIG. 2 is an enlarged fragmentary view of FIG. 1.
Figure 3:
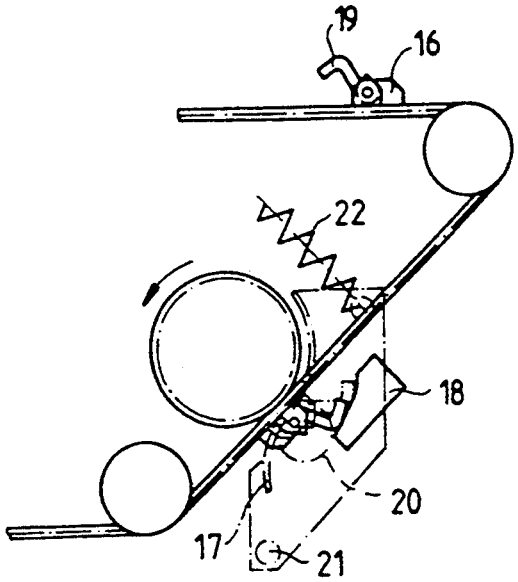
FIG. 3 is a further enlarged fragmentary view of FIG. 2.
Figure 5:
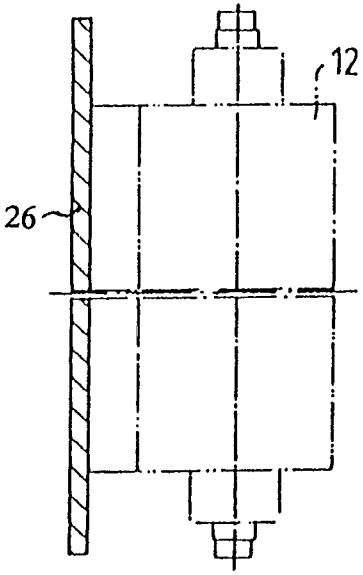
FIG. 5 is a fragmentary view of FIG. 4 showing a detail thereof for facilitating the pulling or drawing-in of the cleaning cloth.

Referring now to the drawings and, first, particularly to FIGS. 1 to 3 thereof, there is shown therein diagrammatically an arrangement of a washing device generally identified by reference character 1 for cleaning the circumferential or peripheral outer cylindrical surface of a rubber-blanket cylinder 2 and also of an impression cylinder 3 in a printing unit of a printing press suitable for offset printing, the cylinders 2 and 3 being rotatably mounted or journalled at the ends thereof in a frame 4 of the printing press. Reference character 5 identifies, for example, a plate cylinder of such a printing press. The washing device 1 includes a clean-cloth spindle 6 and a dirty-cloth spindle 7, a cleaning cloth 8 and a pressure pad 9, the pressure pad 9, in the illustrated embodiment, being disposed at the front end of a swivel head 11 movable about a swivel shaft 10, and made up of, for example, a linearly movably guided ram or punch formed of an elastic material or of a diaphragm or membranous wall of a chamber inflatable by compressed air. The swiveling arrangement of the pressure pad 9 permits the washing device 1 to be used for cleaning both the rubber-blanket cylinder 2 as well as the impression cylinder 3, as is readily apparent from the drawing and as is well known in the art. The axes of the clean-cloth spindle 6, the dirty-cloth spindle 7 and the swivel shaft 10 are aligned parallel to the axes of the cylinders 2 and 3. From a supply reel 12 mounted on the clean-cloth spindle 6, the cleaning cloth 8 is guided over deflector members or pulleys around the outside of the pressure pad 9 to the dirty-cloth spindle 7, the circumferential or peripheral surface of the dirty-cloth spindle 7 being provided with adhesion elements by means of which the cleaning cloth 8 is tenaciously connected with the dirty-cloth spindle 7.

Figure 4:
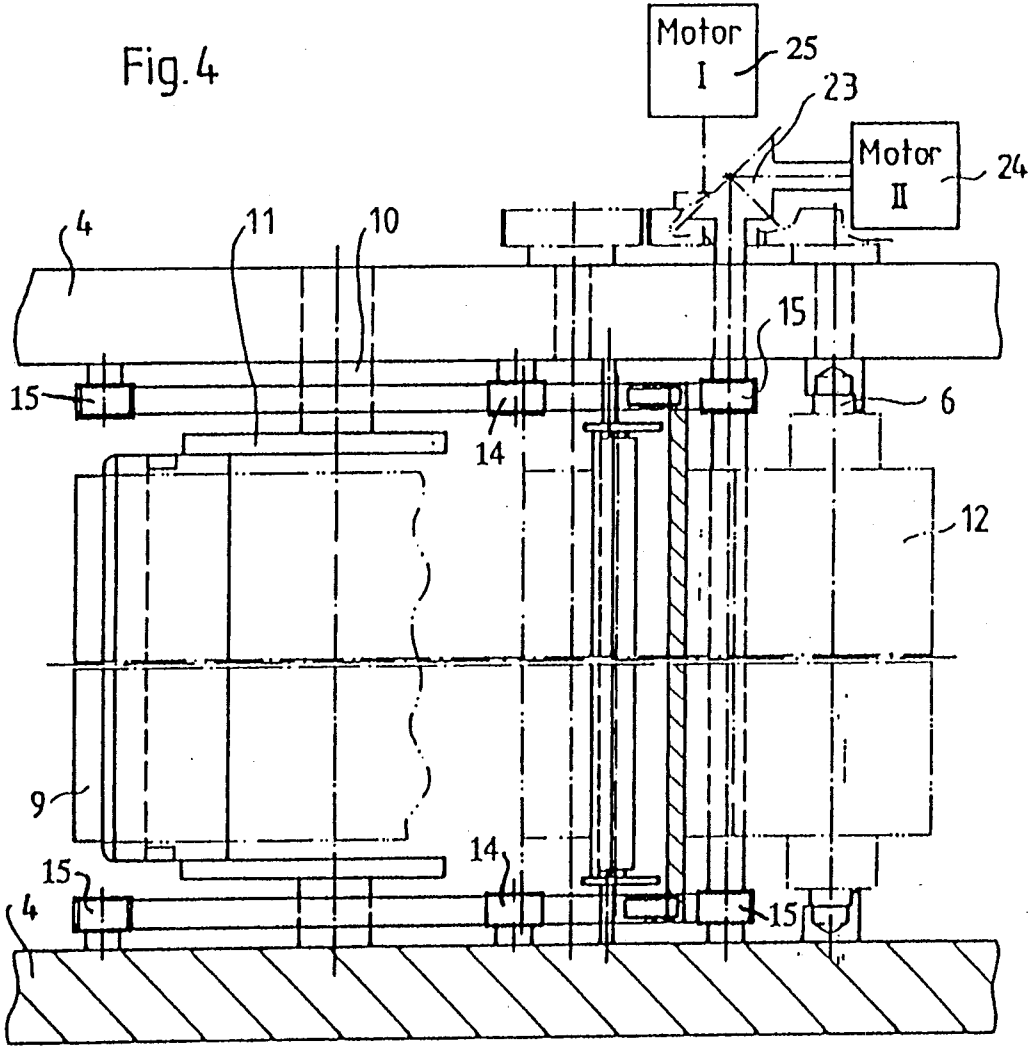
FIG. 4 is a partly diagrammatic top plan view of the washing device according to the invention installed in a printing unit.

To facilitate the pulling or drawing of the cleaning cloth 8 into the washing device 1, an endlessly revolvingly guided belt 13, preferably a toothed belt, is disposed on both sides, respectively, of the printing press. On each printing-press side, the toothed belt 13 disposed thereat is guided over guide pulleys 14, which are journalled on the printing-press frame 4. A pulley or deflector member 15 is disposed in the vicinity of the clean-cloth spindle 6. Attached to each toothed belt 13 is a gripper 16, which can be closed either manually or by mechanical auxiliary means. The gripper 16 grips the leading edge of the cleaning cloth 8 running off the supply reel 12, so that, through the motion of the two toothed belts 13 or the like, the cleaning cloth 8 can be guided around the outside of the pressure pad 9 to the dirty-cloth spindle 7. Provided in the vicinity of the dirty-cloth spindle 7 is a guide plate 17 for the cleaning cloth 8, the guide plate 17 pressing the cleaning cloth 8 against the adhesion elements on the circumferential surface of the dirty-cloth spindle 7, and thereby connecting the cleaning cloth 8 thereto. Further disposed in a locally-fixed manner in the vicinity of the dirty-cloth spindle 7 is a gripper-opening cam 18, which cooperates with a cam lug 19 on a lug of the gripper 16 and opens the gripper 16 the instant the cleaning cloth 8 is pressed against the dirty-cloth spindle 7, and is adheringly connected thereto. The gripper 16 may also be closed by the same cam lug 19 the instant the leading edge of the cleaning cloth 8 has been inserted into the opened gripper 16 and a pulling or drawing-in motion of the two toothed belts 13 or the like occurs. A press-applying shaft 20 reinforces or intensifies the pressure of the cleaning cloth 8 against the circumferential surface of the dirty-cloth spindle 7, so that a reliable connection is established between the cleaning cloth 8 and the circumferential surface of the dirty-cloth spindle 7 when the gripper 16 is opened by the gripper-opening cam 18. The guide plate 17 or the like and the press-applying shaft 20 are mounted so as to be movable about a shaft 21 and are spring-loaded against the circumferential surface of the dirty-cloth spindle 7 by a spring 22. To facilitate the introduction of the leading edge of the cleaning cloth 8 into the opened grippers 16 on the toothed belts 13, a fixed edge 26, projecting widthwise beyond the cleaning cloth 8, is formed on the leading edge of the cleaning cloth 8 running off the supply reel 12 on the clean-cloth spindle 6 or is retrospectively connectable thereto by adhesive or the like, so that the lateral ends of the edge 26 can be introduced into the grippers 16 on the toothed belts 13 which revolve laterally on the frame wall 4. The movement of the toothed belts 13 may be effected manually or by a motorized drive, for example, as shown in FIG. 4. The shaft of the pulley 15 for the toothed belts 13 is connected to a drive motor 24 through the intermediary of a bevel-gear transmission 23. A drive motor 25 serves to drive the cleaning cloth 8 and is controlled by a computer program, which provides a sectional feed of the cleaning cloth 8 and partial reverse transport of the cleaning cloth 8 after each cleaning operation and, finally, provides for a rewinding of the used cleaning cloth from the dirty-cloth spindle 7 to the clean-cloth spindle 6, as is described in the aforementioned published German Patent Document DE 38 41 260 A1.

I claim:

1. Washing device for cylinders of a printing press including an exchangeable supply reel mounted on a clean-cloth spindle and having a cleaning cloth running off therefrom, a pressure pad for pressing the cleaning cloth against a circumferential surface of a respective cylinder of the printing press, a dirty-cloth spindle onto which the cleaning cloth is windable, and drive means for sectionally feeding the cleaning cloth and for rewinding the cleaning cloth from the dirty-cloth spindle onto the supply reel on the clean-cloth spindle, comprising means for automatically pulling the cleaning cloth into the washing device, respective deflector members disposed in the vicinity of the clean-cloth spindle and in the vicinity of the pressure pad, said pulling means including at least one traction means endlessly revolvable over said deflector members, gripper means carried by said traction means for gripping a leading edge of the cleaning cloth running off the supply reel, and means disposed in vicinity of the dirty-cloth spindle for opening said gripper means to receive the leading edge of the cleaning cloth therein, said dirty-cloth spindle carrying adhesion elements on a circumferential surface thereof engageable with the cleaning cloth.

2. Washing device according to claim 1, wherein the drive means comprise a motorized drive for said endlessly revolvable traction means.

3. Washing device according to claim 1, wherein said endlessly revolvable traction means comprise at least one of a belt strap, a toothed belt, a chain and a cable.

4. Washing device according to claim 1, wherein one of said traction means carrying said gripper means is disposed on each side of the printing press.

5. Washing device according to claim 1, wherein said means for opening said gripper means comprise a cam lug formed on a movable finger of said gripper means, and a gripper-opening cam fixed to the printing-press frame in the vicinity of the dirty-cloth spindle.

6. Washing device according to claim 1, including a cloth-guiding plate disposed in the vicinity of the dirty-cloth spindle for pressing the cleaning cloth against the circumferential surface of the dirty-cloth spindle.

7. Washing device according to claim 6, wherein said cloth-guiding plate is movably guidable, and including a spring for radially spring-loading said cloth-guiding plate against the circumferential surface of the dirty-cloth spindle.

8. Washing device according to claim 1, including a gripper-closing cam disposed in a locally-fixed manner in the vicinity of the clean-cloth spindle for closing said gripper means.

9. Washing device according to claim 1, including a fixed edge on the leading edge of the cleaning cloth running off the supply reel on the clean-cloth spindle, the fixed edge projecting widthwise beyond the cleaning cloth.

10. Washing device according to claim 9, wherein the fixed edge is a strip of material affixed to the leading edge of the cleaning cloth.

* * * * *